US005957564A

United States Patent [19]

Bruce et al.

[11] Patent Number: 5,957,564

[45] Date of Patent: Sep. 28, 1999

[54] LOW POWER LIGHTING DISPLAY

[75] Inventors: Dana G. Bruce; Bobby G. Pryor, both of Dallas, Tex.

[73] Assignees: Dana G. Bruce; Bobby G. Pryor, both of Dallas, Tex.

[21] Appl. No.: 08/824,834

[22] Filed: Mar. 26, 1997

Related U.S. Application Data

[63] Continuation-in-part of application No. 08/622,111, Mar. 26, 1996, abandoned.

[51] Int. Cl.[6] ..... H05B 33/08; G09G 3/12

[52] U.S. Cl. ..... 362/84; 362/184; 362/251; 315/169.3

[58] Field of Search ..... 362/20, 84, 183, 362/184, 189, 227, 240, 249, 251, 267, 278, 320, 800, 806; 315/86, 169.3, 185 S, 159, 314, 316, 324, 360; 307/48, 66; 40/544; 313/511, 512

[56] References Cited

U.S. PATENT DOCUMENTS

| | | | |
|---|---|---|---|
| 3,153,745 | 10/1964 | Gurian et al. | 313/511 |
| 3,286,115 | 11/1966 | Ranby et al. | 313/511 |
| 4,138,620 | 2/1979 | Dickson | 362/84 |
| 4,319,310 | 3/1982 | Kingsley | 362/183 |
| 4,376,145 | 3/1983 | Frame | 40/544 |
| 4,384,317 | 5/1983 | Stackpole | 362/183 |
| 4,597,033 | 6/1986 | Meggs et al. | 362/278 |
| 4,622,623 | 11/1986 | Zei | 362/84 |
| 4,718,185 | 1/1988 | Conlin et al. | 40/442 |
| 4,730,146 | 3/1988 | Maser et al. | 313/511 |
| 4,835,664 | 5/1989 | Wen | 362/183 |
| 4,908,743 | 3/1990 | Miller | 362/240 |
| 4,977,488 | 12/1990 | Spotts et al. | 362/183 |
| 4,982,176 | 1/1991 | Schwarz | 340/567 |
| 4,990,971 | 2/1991 | Le Creff | 362/240 |
| 5,055,984 | 10/1991 | Hung et al. | 362/183 |
| 5,107,637 | 4/1992 | Robbins | 52/28 |
| 5,121,307 | 6/1992 | Moore | 362/183 |
| 5,149,188 | 9/1992 | Robbins | 362/183 |
| 5,155,668 | 10/1992 | Tanner et al. | 362/183 |
| 5,217,296 | 6/1993 | Tanner et al. | 362/183 |
| 5,228,772 | 7/1993 | Mitchell et al. | 362/183 |
| 5,237,490 | 8/1993 | Ferng | 362/183 |
| 5,253,150 | 10/1993 | Vanni | 362/183 |
| 5,367,442 | 11/1994 | Frost et al. | 362/183 |
| 5,442,259 | 8/1995 | Lameris | 315/169.3 |
| 5,451,842 | 9/1995 | Chien | 315/169.3 |
| 5,467,257 | 11/1995 | Shalvi | 362/183 |
| 5,469,342 | 11/1995 | Chien | 362/84 |
| 5,493,183 | 2/1996 | Kimball | 315/169.3 |
| 5,517,089 | 5/1996 | Ravid | 315/169.3 |
| 5,519,288 | 5/1996 | Tatsumi et al. | 315/169.3 |

OTHER PUBLICATIONS

Resnick, "Fundamentals of Physics", Second Edition, pp. 697–698, 1970.

*Primary Examiner*—Alan Cariaso
*Attorney, Agent, or Firm*—Strasburger & Price, L.L.P.

[57] ABSTRACT

An off-mains lighting display comprises a plurality of electro-luminescent lamps (ELs) connected in parallel across a rechargeable battery that is connected to the ELs through an inverter. A solar panel device recharges the battery.

Electroluminescent lamps for use in light strings are produced by cutting decorative shapes from existing electroluminescent material and mounting them back to back, in receptacles connected to electric wiring as in conventional light strings. For greater protection and ease of use the lamps may be mounted inside a length of clear plastic tubing, or may be laminated within layers of plastic material.

5 Claims, 8 Drawing Sheets

I G I

D ID D

I A A ED

LOW POWER LIGHTING DISPLAY

This is a continuation-in-part application of pending U.S. application Ser. No. 08/622,111 filed on Mar. 26, 1996 now abandoned.

FIELD OF THE INVENTION

The present invention relates to lighting displays that utilize extremely low amounts of power and can be powered by other than mains electricity or conventional generators.

BACKGROUND OF THE INVENTION

There are a variety of situations in which it is desirable to provide a lighting display which has an extremely low power requirement, for example to provide a display at a location remote from a supply of normal 120 volt AC electric current, and where a conventional diesel generator could not be used. Such situations include the provision of exterior lighting displays for homes during the winter holiday season and stand-alone lighting needs, such as signs and decorations, at remote locations.

A major problem associated with presently available displays is that they require large amounts of electric power and so have to be connected to the main AC electric supply for the house. This typically requires the use of numerous electric connection leads that, in use, extend across the grounds of the house and which carry significant levels of electric current and have to be connected to an electrical outlet or outlets of the house. This arrangement creates dangers associated with overloading the wires, such as fire or shock. Therefore, a need exists for a lighting display assembly which can operate with low power consumption, including displays that can operate for extended periods without being coupled to electric mains.

SUMMARY OF THE INVENTION

The present invention provides, in one aspect, a lighting display comprising a plurality of light emitting devices constructed or adapted to consume low power and a source of stored electrical power sufficient to power said light emitting devices for a substantial period of time. The light emitting devices desirably each requires less than about 10 mA (milliamp) current for operation. Advantageously, the light emitting device is an electroluminescent device with a power consumption of less than about 0.1 watts per square inch of light emitting surface. The invention may further include apparatus for recharging the source of stored electrical power. In one form of the invention, the light emitting devices are connected in parallel across the electrical power source.

The light emitting devices are constructed to consume relatively low power, such as LED devices, gas discharge devices, including neon and fluorescent tubes, or electroluminescent devices ("EL" devices), or light pipe sources. Alternatively, incandescent bulbs may be used, typically miniature bulbs with a power requirement of about 0.5 watts per bulb, in combination with a power saving device such as a switch control providing flicker, wave, flash or light frequency on/off (pulse width modulation) operation of the bulbs.

The apparatus for recharging the electrical power source may include a solar panel and/or a wind driven propeller to obtain energy from the environment. The recharging apparatus can be connected to the electrical power source, although located remotely from the electrical power source, so that the electrical power source does not have to be removed from its location for recharging to occur.

The invention may further provide an adjustable timing device to pre-set the times at which the light emitting devices are operating. Alternatively, an electrical sensor may be provided to turn on the display at dusk, in which case a timing device would turn off the display after a set period of operation.

The electrical power source may be a battery, such as a nickel hydride, nickel cadmium or lead/acid battery.

The individual components of the lighting display, namely the light emitting devices, the source of electrical power and the recharging apparatus may be separate units that can be electrically interconnected, so that the light emitting devices can be placed at a desired location, such as on a hedge, while the electrical power source is placed on the ground and the recharging apparatus on a roof or other higher and exposed structure. Alternatively, the electrical power source and the recharging device can be incorporated in a single housing to reduce cost, but at the expense of reduced operating flexibility.

In one form of the invention, the electrical power source includes a plug-in charger so that the source can be recharged from a household 120 V AC current supply. This has the advantage of allowing unlimited recharging energy, but requires the source to be removable to the supply or that a lead be extended from a main power outlet to the charger of the source.

An important advantage of the invention is that the lights can be operated off batteries for extended periods with no charging required. Due to the low current draw of the EL technology, barriers present in other systems can be overcome. Operation for up to four days is possible with the current battery being used and no charging. A lantern battery would be an economical means of power for a stand alone system. The system would be used until the battery needs recharging, then the battery could be charged indoors (or replaced) using an AC charger while a fresh battery is installed in the light string.

Use of a battery as the power source brings the safety inherent in low voltage operation to the system. The AC current from the inverter used to power the lights is current limited, so that fire or death is unlikely to result from coming into contact with exposed wires, etc.

The system is extremely portable since no external cords are required.

In another aspect, the present invention also provides a novel lighting system employing electro-luminescent lamps connected in parallel. The EL lamps can be provided with connecting plugs enabling them to be mounted in the receptacles of conventional incandescent light strings. Alternatively, the invention provides for a novel construction in which the EL lamps and the associated electrical connectors between them are protected by laminated layers of clear plastic, or by being housed within plastic tube, sealed its ends to protect the lamps.

The EL lamps can be operated directly off 120 V AC with a reduction in brightness and longevity of the lamps (life is still excellent). No inverters or additional components are required for this type of operation. A circuit could be incorporated to change the operating frequency of the lights to increase the brightness level if desired.

The reduced power levels required by EL lamps allows multiple light strings to be connected end to end, thus helping to eliminate overloading of household electric circuits and the associated fire hazard and reducing the size of the wiring required for safe operation of a light string.

A display made up of a large number of EL lamps in multiple light strings connected end to end enables all the lights to be controlled together. This allows for very large displays with the light operation synchronized (i.e., one light controller switching all the lights on and off at the same time).

Due to decreased current draw, the possibility of overloading house circuits is reduced. If long strings are not required, a current limiting resistor, or fuse, can be incorporated to limit the current to lower or non-fatal levels.

The power savings from these low power lights will significantly decrease power usage during the holidays.

An ornament or bulb replacement can be made that plugs into existing AC light strings. The ornament could be clear with a shape inside it, etc. Alternatively, an entire string of ornaments can be made.

BRIEF DESCRIPTION OF THE DRAWINGS

The invention will now be described by way of example only with reference to the accompanying drawing in which.

DETAILED DESCRIPTION OF THE DRAWINGS

Figure 1:
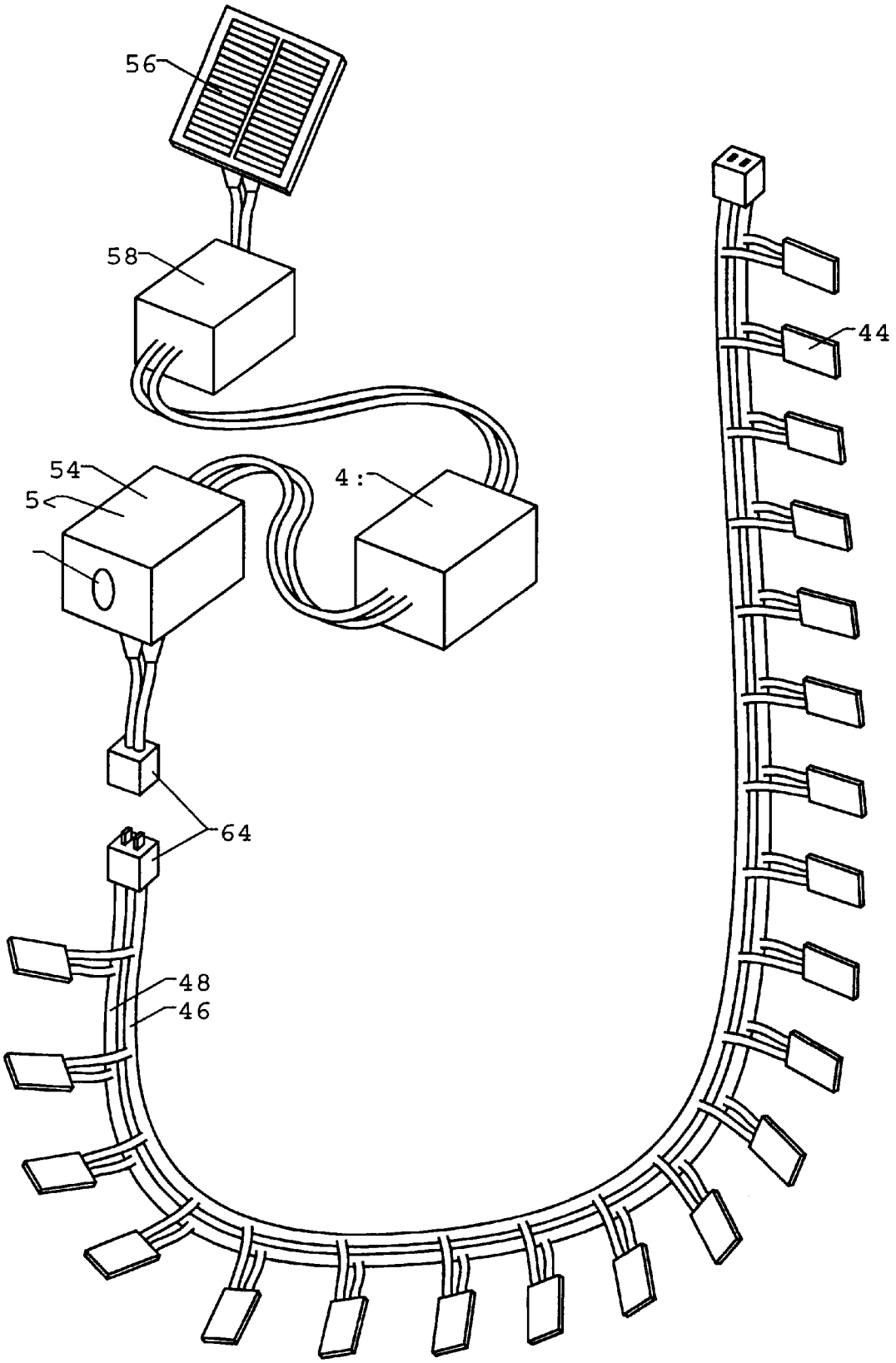
FIG. 1 is a schematic illustration of an ornamental outdoor light set embodying the invention.
Figure 2A:
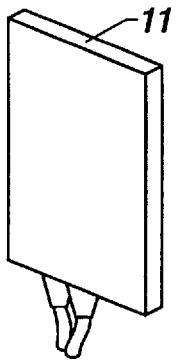
FIGS. 2*a* to 2*f* illustrate various light shapes that can be used in the light set.
Figure 2B:
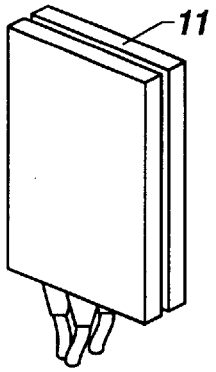
Figure 2C:
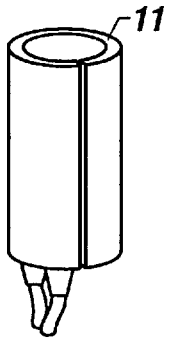
Figure 2D:
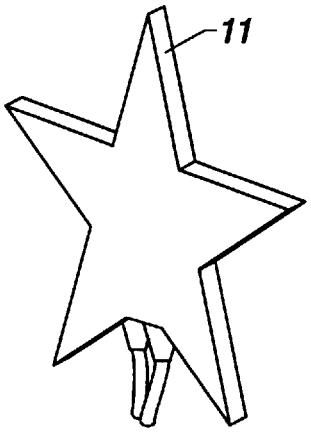
Figure 2E:
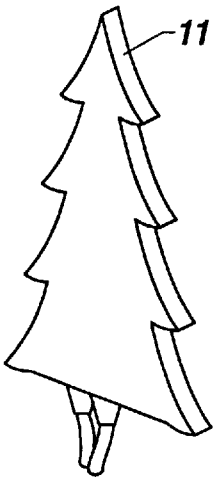
Figure 2F:
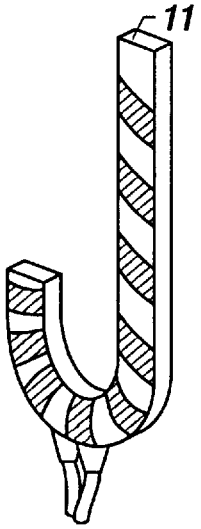

Referring to FIG. 1, a plurality of light emitting devices 11 are connected in parallel by electrical connectors 13, 15 across a battery 17. The light emitting devices 11 are electro-luminescent lamps ("ELs") and are manufactured in different colors, e.g., blue, white, red, green and yellow. An EL, as will be appreciated by those skilled in the art, is a light emitting capacitor, for example, of phosphor and barium titanate, sandwiched between two electrodes and subjected to alternating current. Application of the current creates a potential between front and rear electrodes of the EL which causes the phosphor to fluoresce, giving off the light. ELs are produced by a number of companies, such as ELTech of Austin, Tex. For example, the green EL, by ELTech, has a power consumption of approximately 40 mW/sq. in. (milliwatts per square inch) inch and a capacitance of 5 nF/square inch (nanofarads per square inch).

Between the battery 17 and the ELs 11 is connected an inverter/controller 21. The inverter portion of the inverter/controller 21, as is well known in the art, converts the D.C. output of the battery to A.C. and also sets the amount of current provided to the ELs and may cause the ELs 11 to cycle on and off at a high rate, for example, in the region of about 100 Hz to 5000 Hz. This cycling could reduce the electrical power consumption of the ELs 11, while still providing an optical effect of constant illumination. The inverter may be a compensating inverter to ensure constant brightness as the ELs age. (The EL's require less than about 10 mA each when operating and have a power consumption of less than about 0.1 watt per square inch of light emitting surface.

The battery 17 is, for example, a nickel hydride battery. The battery 17 is connected to a recharging device, in this case, an array of solar cells 23, such as the SPC-4 battery changer or the PP16000 Power Pak by Solar World. In use, the solar cells 23 are disposed in a position to receive solar energy and may be movably mounted with a turning device that maintains the cells 23 in alignment with incident solar radiation. If necessary, because of the nature of the battery cells, a charging controller 25 is provided to prevent prolonged supply of electric power from the cells 23 to the battery 17 from harming the battery 17 by overcharging it. Typically, available solar charging devices can provide an output between about 6.0 to 12.0 volts. The amount of solar cell surface area is the main factor in determining the power output of the solar cell. They can range from small units which provide less then 0.1 W all the way up to large units which are made up of many cells and provide thousands of Watts. The controller portion of the inverter/controller 21 provides the required voltage and current to the ELs 11. Also included in the controller portion is a light sensor 27 that switches on the ELs 11 at dusk. A timer 29 can be associated with the sensor 27 to turn off the ELs 11 after a pre-set period of operation.

The ELs 11 are connected to the inverter/controller by detachable connector 31. It will be apparent that the other components may be either permanently electrically concealed or may be detachable using a standard connection, such as the one shown at 31.

Figure 4:
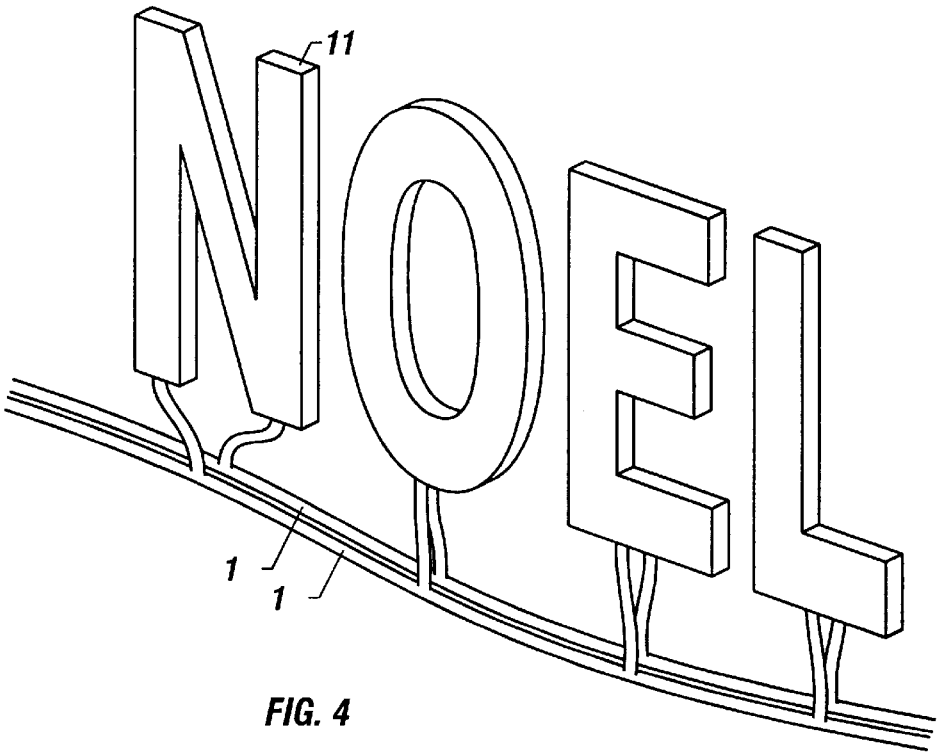
FIG. 4 shows an alternative light set in which the lights are configured to convey a message.

The ELs come in a variety of basic shapes as illustrated in FIGS. 2*a* to 2*f*. For example, the EL can be single-sided 11*a*, double-sided 11*b*, or even circular shaped 11*c*. The ELs can even be fancifully shaped for the holidays. For example, the ELs can be the shape of a star 11*d*, Christmas tree 11*e*, or a candy-cane 11*f*. Alternatively, the ELs can be shaped as letters 11*g*, as shown in FIG. 4.

Figure 3A:
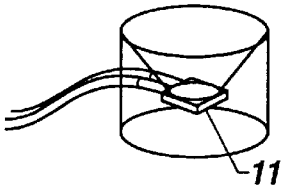
FIGS. 3*a* to 3*c* illustrate various lenses that can be used in the light set of FIG. 1.
Figure 3B:
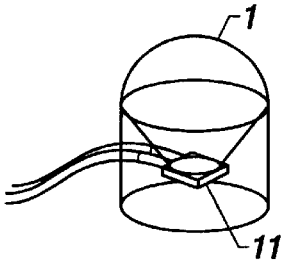
Figure 3C:
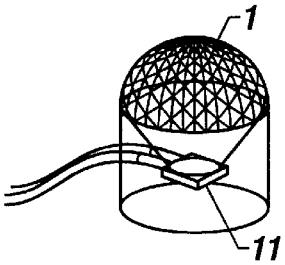

To improve the display performance of the ELs, each may be provided with a device for adjusting the viewing angle. FIG. 3*b* illustrates the use of a simple hemispherical lens to improve the transmission of light from the EL. FIG. 3*c* shows the use of a diffusing lens 19*b*. Of course, no lens is needed as shown in FIG. 3*a*.

Figure 5:
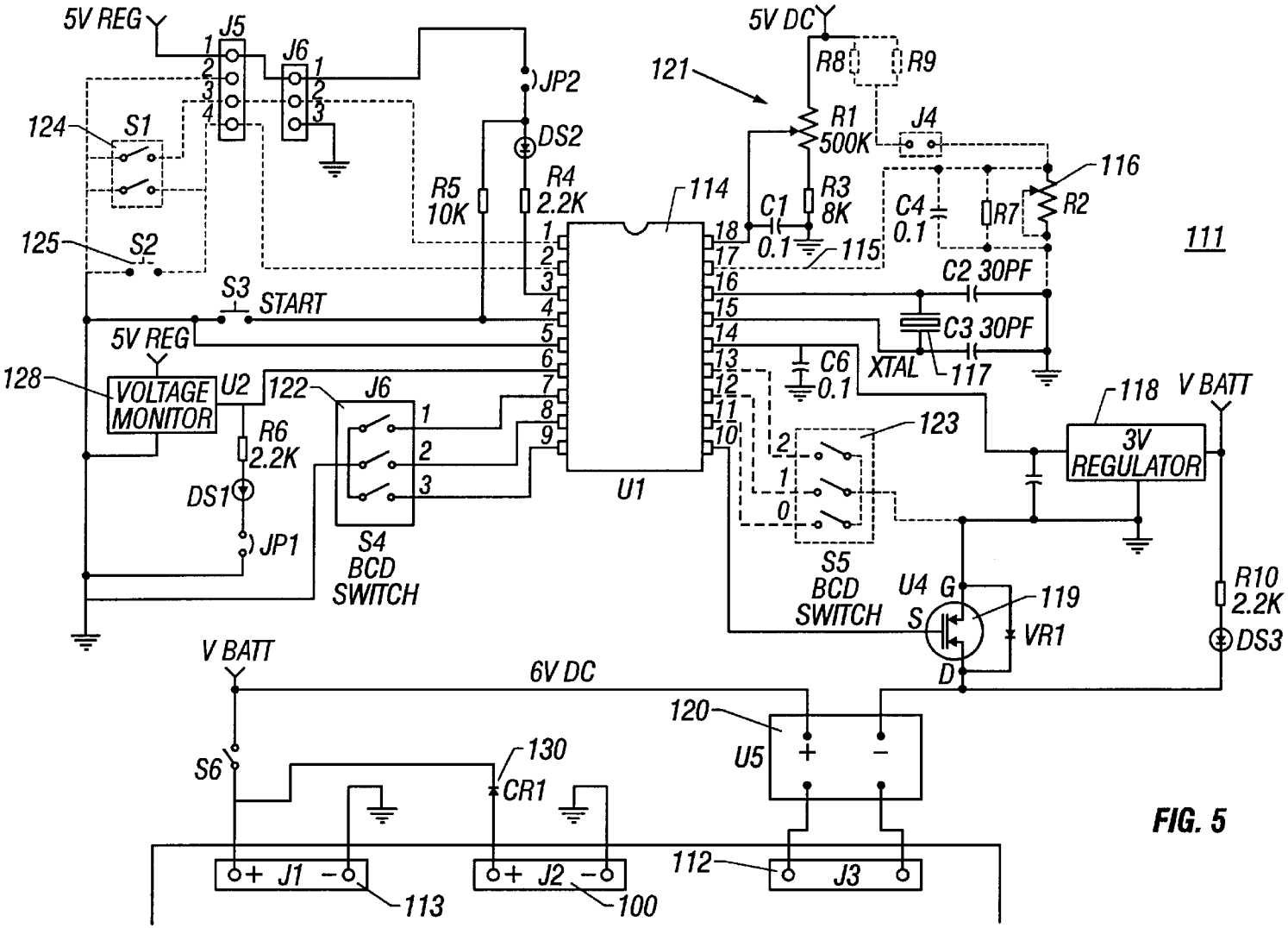
FIG. 5 shows a schematic for a further decorative lighting system embodying the invention.

Referring now to FIG. 5, the low power light system shown therein comprises a lighting controller 111 which controls a plurality of electro-luminescent lights 112. The lights 112 are powered by a battery 113, which can be recharged by means of a solar cell 100. In addition the controller 111 can perform specialized light control functions, such as flashing, fade in/fade out, wave mode etc.

THE CONTROLLER

The controller 111 includes a PIC16C711 eight bit micro-controller IC 114 mounted on a printed circuit board. The controller 111 is fully digital and can be programmed to provide a wide variety of operation modes. Analog input channels 115 of the micro-controller IC 114 are connected to monitor the voltage of the battery 113 and adjustment potentiometers 116. A quartz crystal 117 is connected to the micro-controller IC 114 to generate a time base and produce a stable frequency for timer operations.

A voltage regulator 118 is connected to regulate the voltage from the battery 113 to the micro-controller IC 114 to limit the battery voltage to the range of safe operation of the microprocessor IC 114.

A logic controlled, mosfet transistor 119 is used to switch an AC inverter 120 on and off to control the lights 112. The mosfet transistor 119 has low internal resistance when on and can be controlled by logic levels. The size of the inverter 127 is chosen to match the particular load being driven.

A plurality of switches are connected to the inputs of the micro-controller IC 114 to set the operational mode for the system. A duty cycle switch 122 on the PCB sets the duty cycle, that is the percentage of time on to time off, of the lights 112. A potentiometer 121 controls the flash rate of the lights 112 when flash mode is selected by the duty cycle switch 122.

Switch 123 is left as a spare to enter the run time or run mode of the lights. Switches 124 are spare inputs that can be used for optional switches, or to connect other controllers for synchronization of several light sets or to sense and respond to an external event, such as a door opening, motion in the area of the light display, etc. Switch 125 is used to reset the micro-controller IC 114 and to start a timer in 126.

In an alternative form of the invention, the micro-controller IC 114 is used to switch a transformer to produce AC current and obviating the need for the separate inverter 120.

It has been found that inverters sold by Tech Lite, Inc., as Tech Lite Part #1FP5106-97B, 1FP5106-97C and IFP5106-97A, are suitable for use in the lighting systems of the present invention.

The voltage of the battery 113 is monitored by a voltage monitor IC 128. If the voltage of the battery 113 drops below a certain preset level, the lights 112 are switched off to avoid depletion of the battery 113 below the level at which the micro-processor IC 114 would stop functioning, thus losing the timing data stored in the micro-processor 114.

In an alternative form of the invention, one of the analog inputs of the micro-controller IC 114 performs the monitoring function, thus obviating the need for the separate voltage monitor IC 128.

The battery 113 is charged by means of the solar cell 100 which is connected directly to the battery 113 through a diode 130. The diode 130 prevents current from the battery 113 discharging back into the solar cell 100 when the lights are not lit. The maximum current output from the solar cell 100 will not damage the battery 113, so no sophisticated charge circuitry is needed.

The battery 113 is a sealed lead acid, 6.0 volt, 3.2 Ah (amp hours) battery, for example, the battery sold as Panasonic LC-R063R2PU, which has external dimensions of 2.6 in.× 1.3 in. ×4.92 in.

The solar cell 100 is a 2.5 W, 6.0 volt cell, such as the cell sold by Sun Wize Energy Systems, Inc. as Part #10026.6 or the cell sold by Energy Photovoltaics as Part #EPV 2.5/6 Vv.

Software

Software is loaded into the micro-controller IC 114 to provide the following functions:

When power is applied and the reset button (not shown) is pushed, a timer is zeroed and the lights 112 are turned on.

The lights 112 will operate for four hours in whatever mode is selected by the duty cycle switch 122. The lights can be steady, or several different flash duty cycles can be selected by operation of the duty cycle switch 122.

At the end of the run time (4 hours) the lights 112 will turn off.

Twenty four hours from the time the reset button was first pressed, the lights will come on and operate for four hours, repeating the cycle.

Variations to the software can be made to enable the system to produce effects similar to those produced by light controllers currently on the market and even some features not presently available.

In alternative forms of the invention, the controller 114 can be programmed to operate the lights 112 in a fade in/fade out mode where they gradually dim, then get brighter.

The software can provide a mode in which the lights 112 change operation modes (flashing rate and duration, steady, wave, etc.) at predefined intervals from seconds to hours, thus allowing the mode of the light operation to change during the four hour operating cycle.

A mode can be incorporated using the controller 114 so that if the voltage of the battery 113 drops below a certain threshold, the lights 112 go into flash mode to conserve battery power. This would allow the lights 112 to operate the full four hours in situations where the battery 113 is not sufficiently charged to run on steady continuous operation.

The number of switches can be decreased by having a push button that causes the controller 114 to cycle through its various modes. The particular operator interface chosen is a result of a compromise between cost and ease of use.

One of the additional inputs of the micro controller 114 can be used to synchronize operation with an external event such as a door closing, audio input, etc.

With additional hardware, the controller can be made to play music at various intervals.

The lights 112 use electro-luminescent technology, which has significant advantages compared with the incandescent lights commonly used today.

Low power—When compared to other technologies, EL technology requires from 1/10 (small incandescent lights) to 1/100 (full size incandescent lights) of the power used by conventional lights.

Packaging flexibility—The EL lights can be cut to specific shapes, laminated, and constructed in a variety of formats not previously possible.

Durability—EL lamps are inherently more durable than the incandescent lamps currently used. They are less vibration sensitive than incandescent since there are no fragile filaments that can be easily damaged.

Luminescence—The EL lamps used are configured to deliver approximately 15 ft.-lumens of light for the best viewability versus power consumed ratio.

Figure 6:
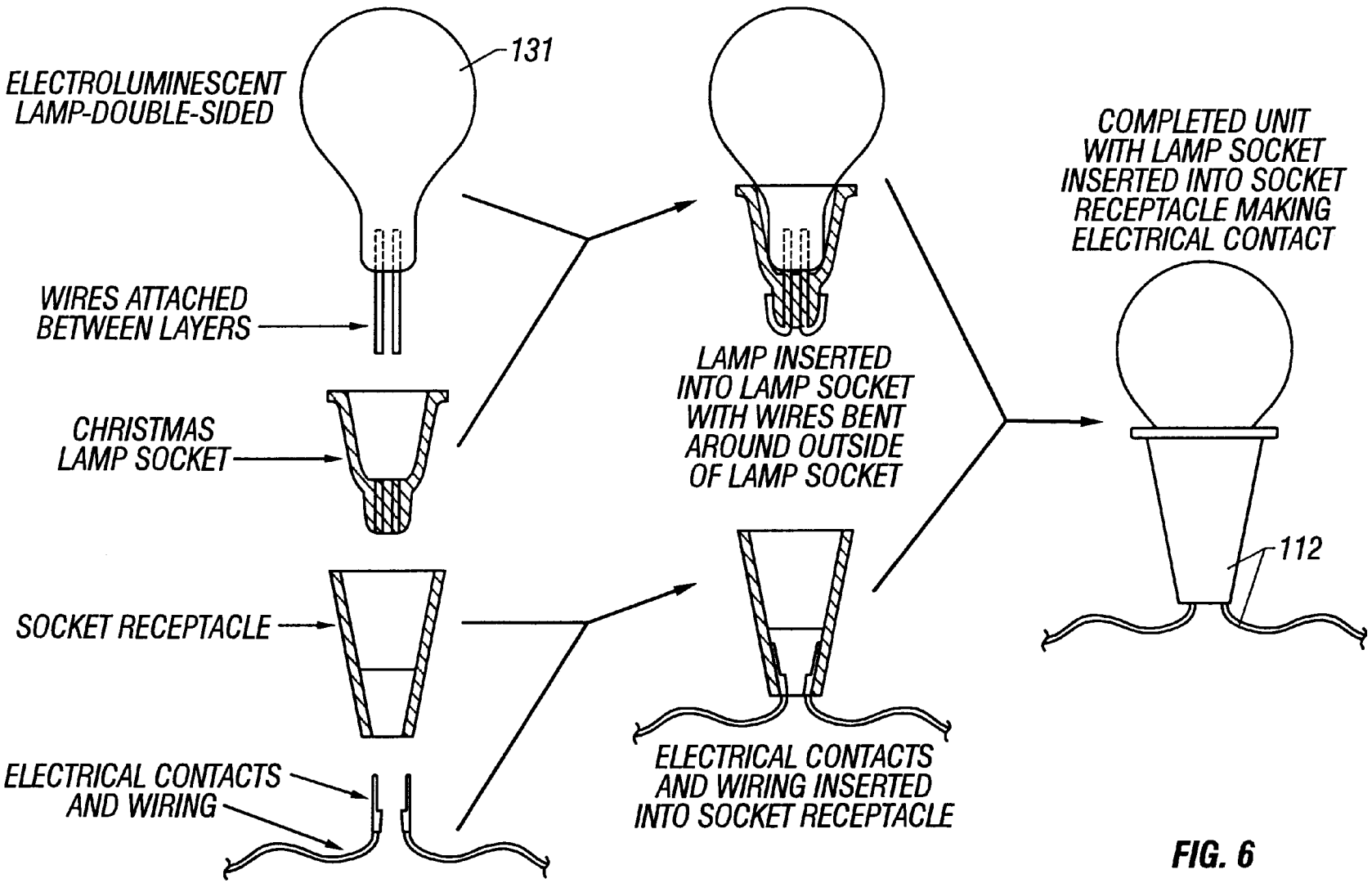
FIG. 6 and 7 show further alternative forms of a light set embodying the invention.
Figure 7:
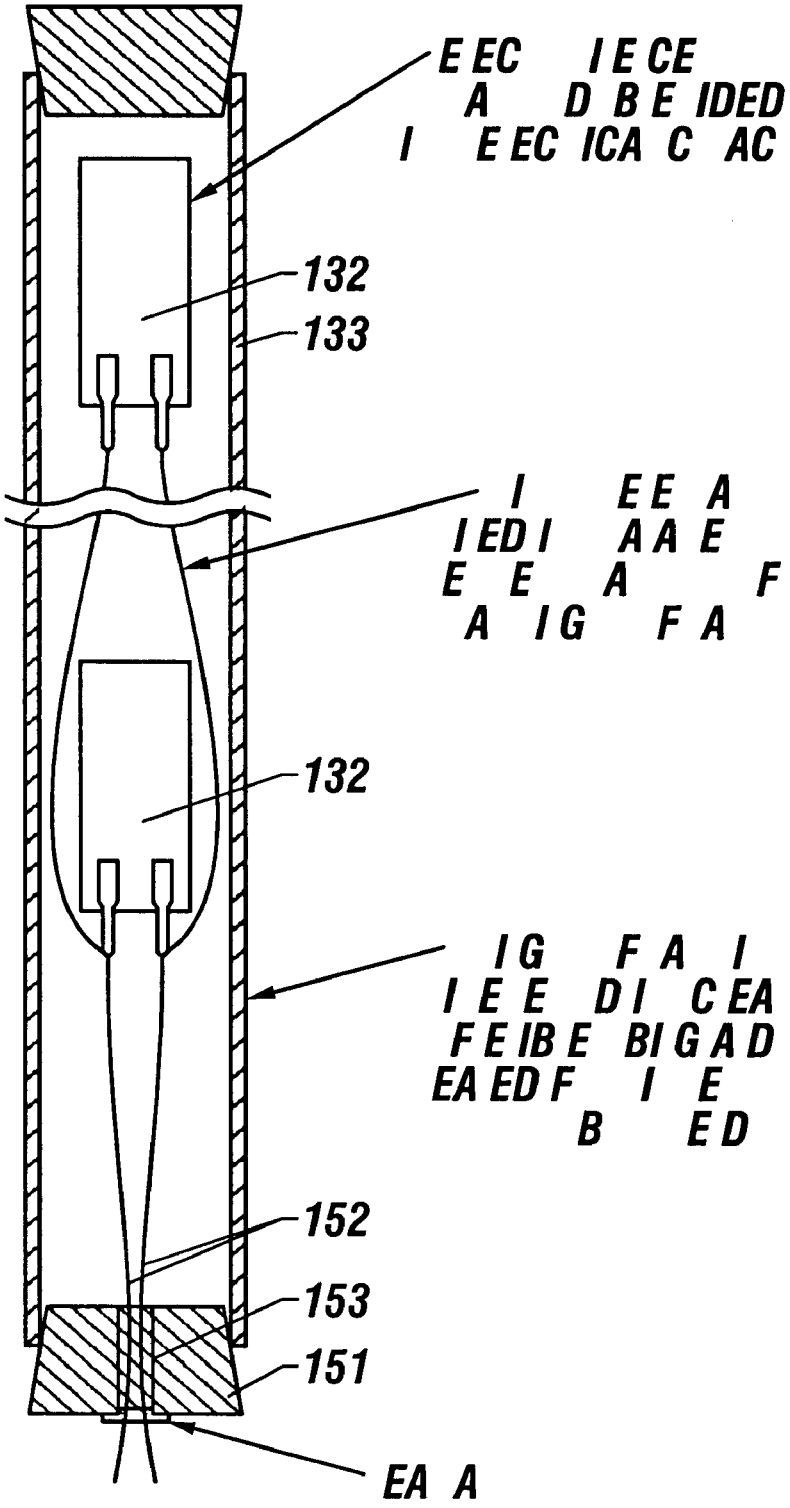

Two different light string sets are illustrated in FIG. 6 and 7 respectively. FIG. 6 shows circular lamps 131 forming a light string 112 connected on a modified version of the leads commonly used for incandescent Christmas lights.

The lamps 131 are formed from the commercially available EL lamps sold as #12094-N Circular lights by Metro-Mark LEI. The lamps 131 have 0.44 in. diameter lighted area and 0.54 in. diameter including the edge seal area. Pairs of one-sided circular lights are mounted back-toback with their light emitting sides outward to provide light on both sides and a total light area of 30.5 sq. in. The two lights are secured together by, for example, adhesive and their edges are sealed by, for example, dipping in conformed acrylic material, or by tape, to protect the lamp from moisture. If necessary, the edges are also covered with an electrically insulating material to reduce the risk of electric shock from the lights. With a string of 95 lamps, the current draw is about 157 mA at 6.0 volts. The lamps 131 are blue, green and blended white, and colored overlays are used to produce green, yellow, orange and red lamp colors.

In an alternative form of the invention, not shown, electroluminescent material is cut to shape and modified to fit an existing incandescent light string. The electroluminescent material is Eltech Nova II Prototype 2 in. by 3 in. lights. A total of twenty-five lamps 134 in various shapes. stars, tree, candy cane, etc., constitute the string, lighted on one side only. The total lighted surface area is 15 sq. in. and the current draw is about 130 mA at 6.0 volts. Color combinations are obtained by using blue, blue-green and white lamps with colored overlays.

FIG. 7 illustrates a light string comprising a plurality of rectangular electroluminescent lamps 132 wired in parallel mounted in clear plastic tubing 133. The lamps 132 are formed from commercially available EL lamps sold as #12095-N rectangular light by MetroMack. The lamps 132 have 0.3 in. by 0.5 in. lighted area and 0.4 in. by 0.6 in. including the edge seal area. With back-to-back configuration to provide light on both sides, the string had a total lighted area of 15 sq. in. The current draw is about 142 mA at 6.0 volts. The same color options can be obtained as for the light string described with respect to FIG. 6. The lamps 132 are mounted within a clear tube 133 of polyurethane or polypropylene material, the diameter of which is about ⅝ in. The lamps 132 are retained in position in the tube 133 by end plugs 151. Electric leads 152 for supplying electric power to the lamps 132 extend through a passage 153 in one of the end plugs 151 and terminate externally in a plug, not shown.

The electroluminescent light string shown in FIG. 7 that is contained in tubing 133 which is sealed at its ends has the advantage of protecting the electroluminescent lamps from both moisture and contact damage and eliminating any wiring tangles when storing or working with the light string.

The light string shown in FIG. 7 can be constructed as follows:

1. Produce individual electroluminescent lamps 132 of the desired shape, wire the individual lamps together and insert the assembly into clear plastic tubing 133.

Alternative forms of the light string shown in FIG. 7 can be constructed as follows:

a. Produce the electroluminescent light portions and their connecting wiring, ink, etc. on one continuous flexible substrate. This substrate can then be inserted into plastic tubing.

b. Produce the electro-luminescent light portions and their connecting wiring, ink, etc. as a separate layer. Then encapsulate or laminate on both sides of the light layer using a flexible transparent material such as polycarbonate, or urethane material to form a flexible tape. This flexible tape can then be inserted into plastic tubing.

Figure 8:
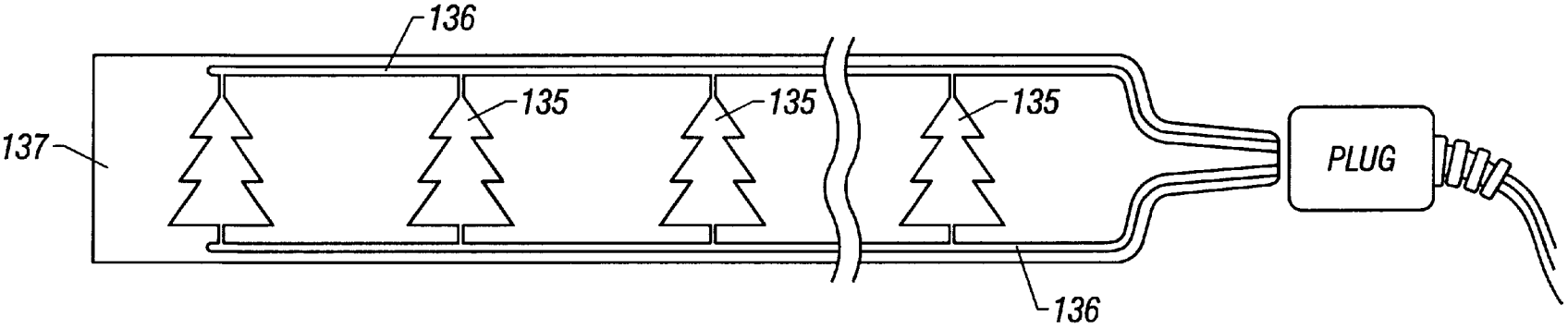
FIG. 8 shows an alternative method of providing a light set embodying the invention.
Figure 9C:
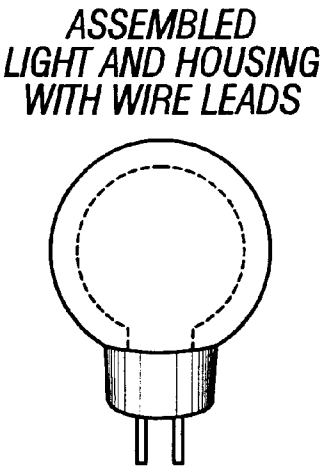
FIG. 9 illustrates a method of manufacturing an electroluminescent light for use in the present invention.
Figure 9B:
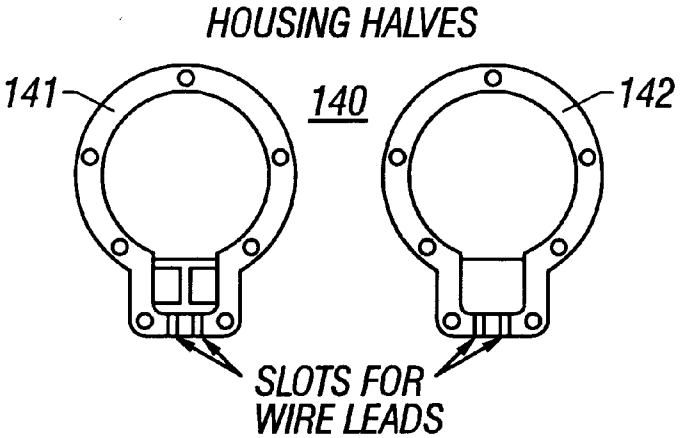
Figure 9B:
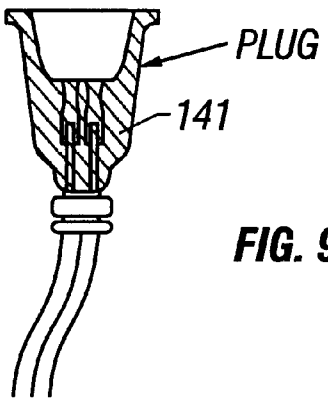
Figure 9A:
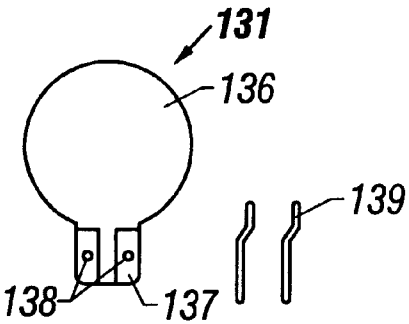

FIG. 8 illustrates an alternative method of constructing the light string 112. As seen in FIG. 8, EL lamps 135 are made in a tape format, with the electroluminescent material sandwiched between two transparent layers of flexible plastic material 137, such as polycarbonate, Aclar, or polyester based film. Electrically conductive ink, wire, or flexible copper conduction 136 provides electric power to the lamps 135 via conventional electric wiring and a plug.

A laminated form of the electroluminescent light string such as that shown in FIG. 8 lends itself well to volume production techniques. This method of production results in a flexible laminated tape version of the electroluminescent light strings. The electroluminescent lamps are protected from both moisture and most contact damage, and the possibility of wiring tangles when storing, or working with, the light string is eliminated.

Lamination can be achieved by:

1. Producing the electro-luminescent light portions and their connecting wiring, ink, etc. on one continuous flexible substrate. This can then be sealed by a lamination or coating process to form the desired flexible tape.
2. Produce the electroluminescent light portions and their connecting wiring, ink, etc. as a separate layer that is then encapsulated or laminated on both sides to form the desired flexible tape.

Lamps 131 for use with the light string shown in FIG. 6 can be constructed using a clam-shell design shown in FIG. 9. As seen in FIG. 9, a lamp 131 comprises a piece of electroluminescent material 136 of circular configuration having a stem 137 formed with two holes 138 for attachment of wire leads 139. The EL material 136 is disposed in a housing 140 of transparent plastic material composed of two complementary halves 141 and 142 which have passages for accommodating the wire leads 139 and which can be secured togethe r by, for example, adhesive, heat, or ultrasonic bonding to provide an enclosure for the lamp 136. The assembly of lamp 136, housing 140 and leads 139 can be mounted in an insert plug 141 which is connected to electrical leads, as in conventional light strings.

The insert plug 141 can be made to capture and make electrical contact with the base of the electroluminescent light and then insert or screw into the type of sockets being used on existing light strings.

In an alternative form of the invention, the electroluminescent lamp is encapsulated and further protected. The mating piece can completely contain the electroluminescent light and snap together to form an assembly that is inserted into the type of sockets being used on existing light strings. This encapsulating piece contains the coloration required to obtain the light colors, thus eliminating the need for color overlays in the light manufacturing process. This encapsulating piece is also configured to seal moisture away from the electroluminescent light.

The durability and long life characteristics of electroluminescent lights also make possible an additional configuration for the more typical type of light string. The electrical leads of the electroluminescent light are directly connected to the wiring of the light string and the connection encapsulated in a permanently formed plastic moulding that protects the leads and connection from, for example, water. This eliminates the socket that is typically found on the light strings in existence today. This arrangement eliminates the ability to replace individual light units. However, the durability and long life characteristics of electroluminescent lights make the replacement of lights virtually unnecessary.

Although preferred embodiments of the present invention have been described in the foregoing Detailed Description and illustrated in the accompanying drawings, it will be understood that the invention is not limited to the embodiments disclosed, but is capable of numerous rearrangements, modifications, and substitutions of parts and elements without departing from the spirit of the invention. Accordingly, the present invention is intended to encompass such rearrangements, modifications, and substitutions of parts and elements as fall within the spirit of the invention.

We claim:

1. A lighting display system comprising:

a plurality of electroluminescent lamps;

a battery for powering the system;

a controller for connecting the lamps to the battery and for varying the operation of the system between different modes having different requirements for electrical power;

a voltage monitor connected to monitor the output voltage of the battery;

the controller responding to a fall in the output voltage of the battery sensed by the voltage monitor to switch the operating mode of the system to a reduced power consumption mode.

2. A lighting display system as claimed in claim 1 wherein the controller is an eight-bit micro-controller.

3. A lighting display system comprising:

a battery for supplying electrical power;

an inverter for converting DC current from the battery to AC;

a plurality of low power electric lamps adapted to be powered by the battery;

a micro-controller for controlling the supply of electricity from the battery to the lamps and for controlling the lamps;

a voltage regulator for monitoring the output voltage of the battery and to provide a signal to the micro-controller when the output voltage drops below a predetermined amount.

4. A lighting display system as claimed in claim 3 wherein the controller is programmed to perform a periodic cycle of operation which includes turning on the lights at a predetermined time each day, operating the lights for a pre-set period, turning them off at the end of the period and then repeating the cycle of operation twenty-four hours after the start of the previous cycle.

5. A lighting display system as claimed in claim 3 wherein the controller includes software that causes said system to perform a periodic cycle of operation which includes turning on the lights at a predetermined time each day, operating the lights for a pre-set period, turning them off at the end of the period and then repeating the cycle of operation twenty-four hours after the start of the previous cycle.

* * * * *